US010037691B1

(12) United States Patent
Sekar et al.

(10) Patent No.: US 10,037,691 B1
(45) Date of Patent: Jul. 31, 2018

(54) BEHAVIORAL BASED TRAFFIC INFRACTION DETECTION AND ANALYSIS SYSTEM

(71) Applicant: International Business Machines Corporation, Armonk, NY (US)

(72) Inventors: Deepak Sekar, Mt. Lawley (AU); William J. Shondelmyer, Wellington (NZ)

(73) Assignee: International Business Machines Corporation, Armonk, NY (US)

( * ) Notice: Subject to any disclaimer, the term of this patent is extended or adjusted under 35 U.S.C. 154(b) by 11 days.

(21) Appl. No.: 15/475,954

(22) Filed: Mar. 31, 2017

(51) Int. Cl.
*G08G 1/01* (2006.01)
*G08G 1/017* (2006.01)
*G08G 1/056* (2006.01)

(52) U.S. Cl.
CPC ..... *G08G 1/0175* (2013.01); *G08G 1/056* (2013.01)

(58) Field of Classification Search
CPC ..... G08G 1/0175; G08G 1/056; G08G 1/075; G08G 1/02; G08G 1/01; E01F 13/105
USPC ..... 340/931, 932, 933, 934, 935, 937, 938, 340/939, 940, 941, 942, 943; 348/143, 348/144, 148, 149, 153
See application file for complete search history.

(56) References Cited

U.S. PATENT DOCUMENTS 5,948,038 A 9/1999 Daly et al.
5,952,941 A 9/1999 Mardirossian
6,225,898 B1 5/2001 Kamiya et al.
2002/0141618 A1 10/2002 Ciolli et al.
2004/0252193 A1 12/2004 Higgins
2005/0151671 A1* 7/2005 Bortolotto ..... G08G 1/054 340/936
2008/0062009 A1* 3/2008 Marton ..... G08G 1/0175 340/937
2013/0076906 A1* 3/2013 Rothschild ..... G08G 1/00 348/148
2013/0106622 A1 3/2013 Paul et al.
2014/0222323 A1 8/2014 Purushothaman et al.
2016/0155332 A1* 6/2016 Wang ..... G01C 21/3685 340/932.2

FOREIGN PATENT DOCUMENTS

CN 103077608 12/2014
WO 2014203043 12/2014

* cited by examiner

*Primary Examiner* — Hai Phan
*Assistant Examiner* — Anthony D Afrifa-Kyei
(74) *Attorney, Agent, or Firm* — VanLeeuwen & VanLeeuwen; William J. Stock

(57) ABSTRACT

An approach is provided in which an information handling system detects a traffic infraction of a driver driving a vehicle. In turn, the information handling system forms an infraction detection zone that includes a set of traffic control devices, and sends a set of configuration parameters to the set of traffic control devices. The information handling system then uses vehicle identification data in the set of configuration parameters to identify driving behaviors of the driver through the infraction detection zone and issues a citation based upon the identified driving behaviors.

17 Claims, 7 Drawing Sheets

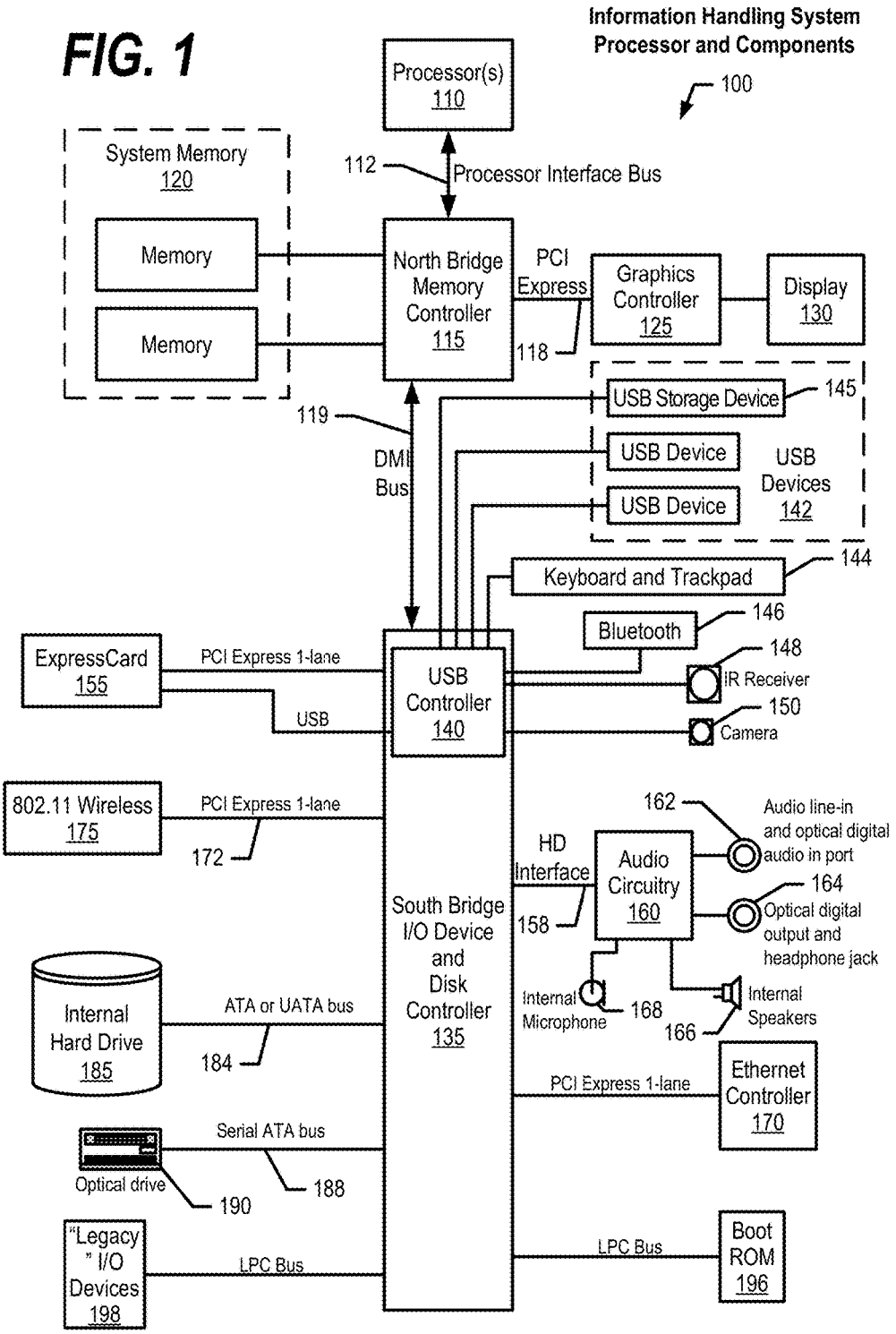
FIG. 1
Information Handling System Processor and Components
100
Processor(s) 110
112
Processor Interface Bus
System Memory 120
Memory
Memory
North Bridge Memory Controller 115
PCI Express
118
Graphics Controller 125
Display 130
119
DMI Bus
USB Storage Device
145
USB Device
USB Device
USB Devices 142
Keyboard and Trackpad
144
Bluetooth
146
148
IR Receiver
150
Camera
ExpressCard 155
PCI Express 1-lane
USB
USB Controller 140
802.11 Wireless 175
PCI Express 1-lane
172
162
Audio line-in and optical digital audio in port
HD Interface
158
Audio Circuitry 160
164
Optical digital output and headphone jack
South Bridge I/O Device and Disk Controller 135
Internal Microphone
168
Internal Speakers
166
Internal Hard Drive 185
ATA or UATA bus
184
PCI Express 1-lane
Ethernet Controller 170
Serial ATA bus
Optical drive
190
188
"Legacy" I/O Devices 198
LPC Bus
LPC Bus
Boot ROM 196

BEHAVIORAL BASED TRAFFIC INFRACTION DETECTION AND ANALYSIS SYSTEM

BACKGROUND

Today's traffic infraction detection systems, such as red light detection systems and bus lane detection systems, monitor driver behavior and automatically issue citations when an infraction is detected. Red light detection systems capture images of vehicles that run a red light and issue citations to the owner of the vehicle. Bus lane detection systems may include sensors that detect a vehicle traveling in a bus lane; trigger a camera to capture an image of the vehicle; compare the vehicle's registration plate with a list of approved vehicles; and issue a citation if the vehicle is not on the list of approved vehicles. Today's traffic infraction detection system may also be used to detect speeding infractions, unauthorized use of a carpool lane, etc., all of which automatically issue citations upon detecting a traffic infraction.

BRIEF SUMMARY

According to one embodiment of the present disclosure, an approach is provided in which an information handling system detects a traffic infraction of a driver driving a vehicle. In turn, the information handling system forms an infraction detection zone that includes a set of traffic control devices, and sends a set of configuration parameters to the set of traffic control devices. The information handling system then uses vehicle identification data in the set of configuration parameters to identify driving behaviors of the driver through the infraction detection zone and issues a citation based upon the identified driving behaviors.

The foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages of the present disclosure, as defined solely by the claims, will become apparent in the non-limiting detailed description set forth below.

BRIEF DESCRIPTION OF THE SEVERAL VIEWS OF THE DRAWINGS

The present disclosure may be better understood, and its numerous objects, features, and advantages made apparent to those skilled in the art by referencing the accompanying drawings, wherein:

FIG. 1 is a block diagram of a data processing system in which the methods described herein can be implemented;

DETAILED DESCRIPTION

Figure 2:
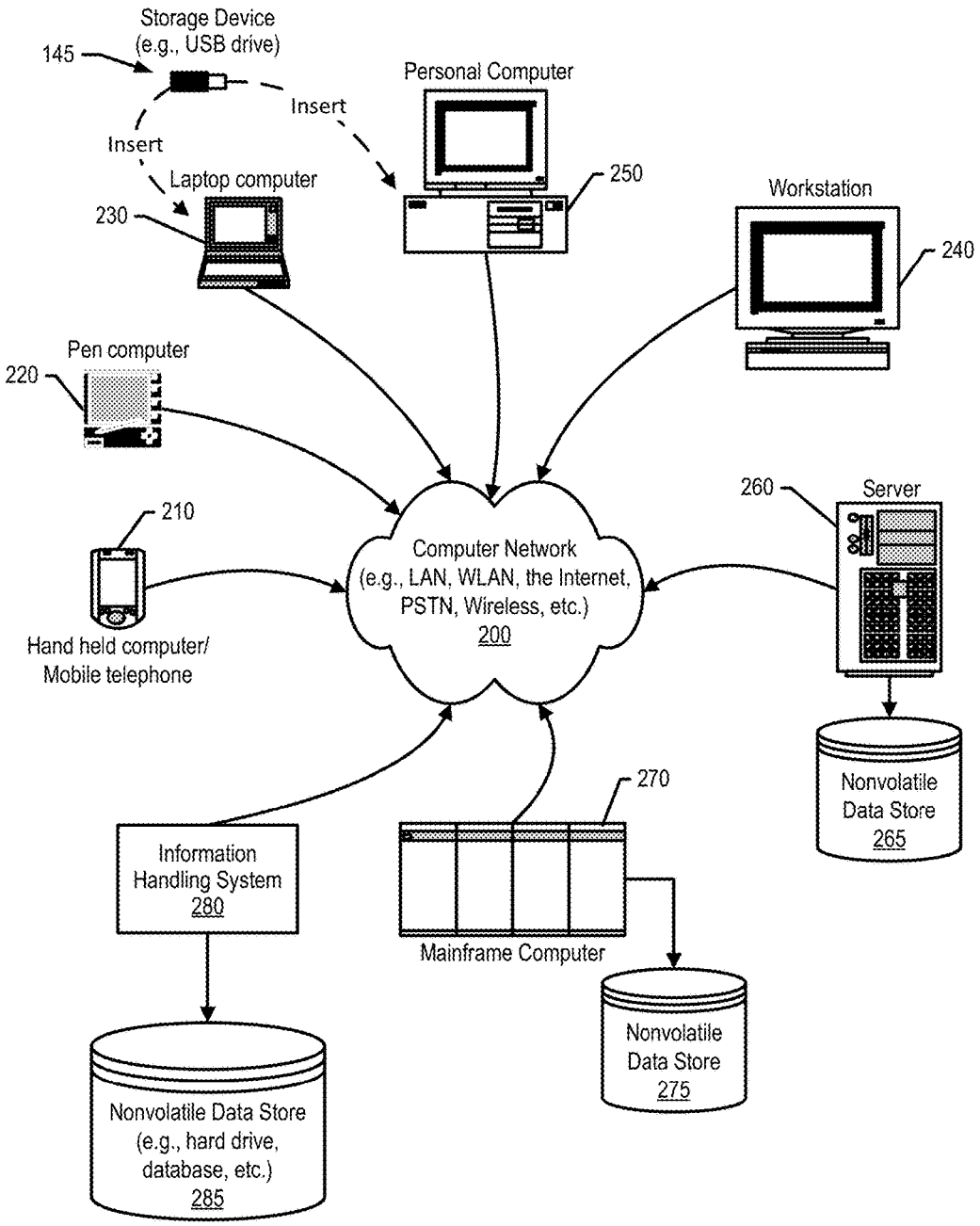
FIG. 2 provides an extension of the information handling system environment shown in FIG. 1 to illustrate that the methods described herein can be performed on a wide variety of information handling systems which operate in a networked environment.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions. The following detailed description will generally follow the summary of the disclosure, as set forth above, further explaining and expanding the definitions of the various aspects and embodiments of the disclosure as necessary.

FIG. 1 illustrates information handling system 100, which is a simplified example of a computer system capable of performing the computing operations described herein. Information handling system 100 includes one or more processors 110 coupled to processor interface bus 112. Processor interface bus 112 connects processors 110 to Northbridge 115, which is also known as the Memory Controller Hub (MCH). Northbridge 115 connects to system memory 120 and provides a means for processor(s) 110 to access the system memory. Graphics controller 125 also connects to Northbridge 115. In one embodiment, Peripheral Component Interconnect (PCI) Express bus 118 connects Northbridge 115 to graphics controller 125. Graphics controller 125 connects to display device 130, such as a computer monitor.

Northbridge 115 and Southbridge 135 connect to each other using bus 119. In one embodiment, the bus is a Direct Media Interface (DMI) bus that transfers data at high speeds in each direction between Northbridge 115 and Southbridge 135. In another embodiment, a PCI bus connects the Northbridge and the Southbridge. Southbridge 135, also known as the Input/Output (I/O) Controller Hub (ICH) is a chip that generally implements capabilities that operate at slower speeds than the capabilities provided by the Northbridge. Southbridge 135 typically provides various busses used to connect various components. These busses include, for example, PCI and PCI Express busses, an ISA bus, a System Management Bus (SMBus or SMB), and/or a Low Pin Count (LPC) bus. The LPC bus often connects low-bandwidth devices, such as boot ROM 196 and "legacy" I/O devices (using a "super I/O" chip). The "legacy" I/O devices (198) can include, for example, serial and parallel ports, keyboard, mouse, and/or a floppy disk controller. Other components often included in Southbridge 135 include a Direct Memory Access (DMA) controller, a Programmable Interrupt Controller (PIC), and a storage device controller, which connects Southbridge 135 to nonvolatile storage device 185, such as a hard disk drive, using bus 184.

ExpressCard 155 is a slot that connects hot-pluggable devices to the information handling system. ExpressCard 155 supports both PCI Express and Universal Serial Bus (USB) connectivity as it connects to Southbridge 135 using both the USB and the PCI Express bus. Southbridge 135 includes USB Controller 140 that provides USB connectivity to devices that connect to the USB. These devices include webcam (camera) 150, infrared (IR) receiver 148, keyboard and trackpad 144, and Bluetooth device 146, which provides for wireless personal area networks (PANs). USB Controller 140 also provides USB connectivity to other miscellaneous USB connected devices 142, such as a mouse, removable nonvolatile storage device 145, modems, network cards, Integrated Services Digital Network (ISDN) connectors, fax, printers, USB hubs, and many other types of USB connected devices. While removable nonvolatile storage device 145 is shown as a USB-connected device, removable nonvolatile storage device 145 could be connected using a different interface, such as a Firewire interface, etcetera.

Wireless Local Area Network (LAN) device 175 connects to Southbridge 135 via the PCI or PCI Express bus 172. LAN device 175 typically implements one of the Institute of Electrical and Electronic Engineers (IEEE) 802.11 standards of over-the-air modulation techniques that all use the same protocol to wireless communicate between information handling system 100 and another computer system or device. Optical storage device 190 connects to Southbridge 135 using Serial Analog Telephone Adapter (ATA) (SATA) bus 188. Serial ATA adapters and devices communicate over a high-speed serial link. The Serial ATA bus also connects Southbridge 135 to other forms of storage devices, such as hard disk drives. Audio circuitry 160, such as a sound card, connects to Southbridge 135 via bus 158. Audio circuitry 160 also provides functionality such as audio line-in and optical digital audio in port 162, optical digital output and headphone jack 164, internal speakers 166, and internal microphone 168. Ethernet controller 170 connects to Southbridge 135 using a bus, such as the PCI or PCI Express bus. Ethernet controller 170 connects information handling system 100 to a computer network, such as a Local Area Network (LAN), the Internet, and other public and private computer networks.

While FIG. 1 shows one information handling system, an information handling system may take many forms. For example, an information handling system may take the form of a desktop, server, portable, laptop, notebook, or other form factor computer or data processing system. In addition, an information handling system may take other form factors such as a personal digital assistant (PDA), a gaming device, Automated Teller Machine (ATM), a portable telephone device, a communication device or other devices that include a processor and memory.

FIG. 2 provides an extension of the information handling system environment shown in FIG. 1 to illustrate that the methods described herein can be performed on a wide variety of information handling systems that operate in a networked environment. Types of information handling systems range from small handheld devices, such as handheld computer/mobile telephone 210 to large mainframe systems, such as mainframe computer 270. Examples of handheld computer 210 include personal digital assistants (PDAs), personal entertainment devices, such as Moving Picture Experts Group Layer-3 Audio (MP3) players, portable televisions, and compact disc players. Other examples of information handling systems include pen, or tablet, computer 220, laptop, or notebook, computer 230, workstation 240, personal computer system 250, and server 260. Other types of information handling systems that are not individually shown in FIG. 2 are represented by information handling system 280. As shown, the various information handling systems can be networked together using computer network 200. Types of computer network that can be used to interconnect the various information handling systems include Local Area Networks (LANs), Wireless Local Area Networks (WLANs), the Internet, the Public Switched Telephone Network (PSTN), other wireless networks, and any other network topology that can be used to interconnect the information handling systems. Many of the information handling systems include nonvolatile data stores, such as hard drives and/or nonvolatile memory. Some of the information handling systems shown in FIG. 2 depicts separate nonvolatile data stores (server 260 utilizes nonvolatile data store 265, mainframe computer 270 utilizes nonvolatile data store 275, and information handling system 280 utilizes nonvolatile data store 285). The nonvolatile data store can be a component that is external to the various information handling systems or can be internal to one of the information handling systems. In addition, removable nonvolatile storage device 145 can be shared among two or more information handling systems using various techniques, such as connecting the removable nonvolatile storage device 145 to a USB port or other connector of the information handling systems.

FIGS. 3 through 7 depict an approach that can be executed on an information handling system to analyze a driver's behavior subsequent to a traffic infraction and issue a citation based on the subsequent behavior. As used herein, the term "traffic infraction" is the act of disobeying traffic regulations (e.g., speeding) and may also be referred to "traffic violations" or "traffic infringements." The term "citation" is being charged for the traffic infraction (e.g., ticket).

As discussed above, today's traffic infraction detection systems automatically issue citations based on a first occurrence of a traffic infraction. The real-time citation determination system disclosed herein detects a driver's initial traffic infraction and analyzes factors such as post behavior through an infraction detection zone; historical driver behavior; and/or historical infractions of other drivers within the same area (e.g., a particular intersection) prior to issuing a citation to the driver's initial traffic infraction.

Figure 3:
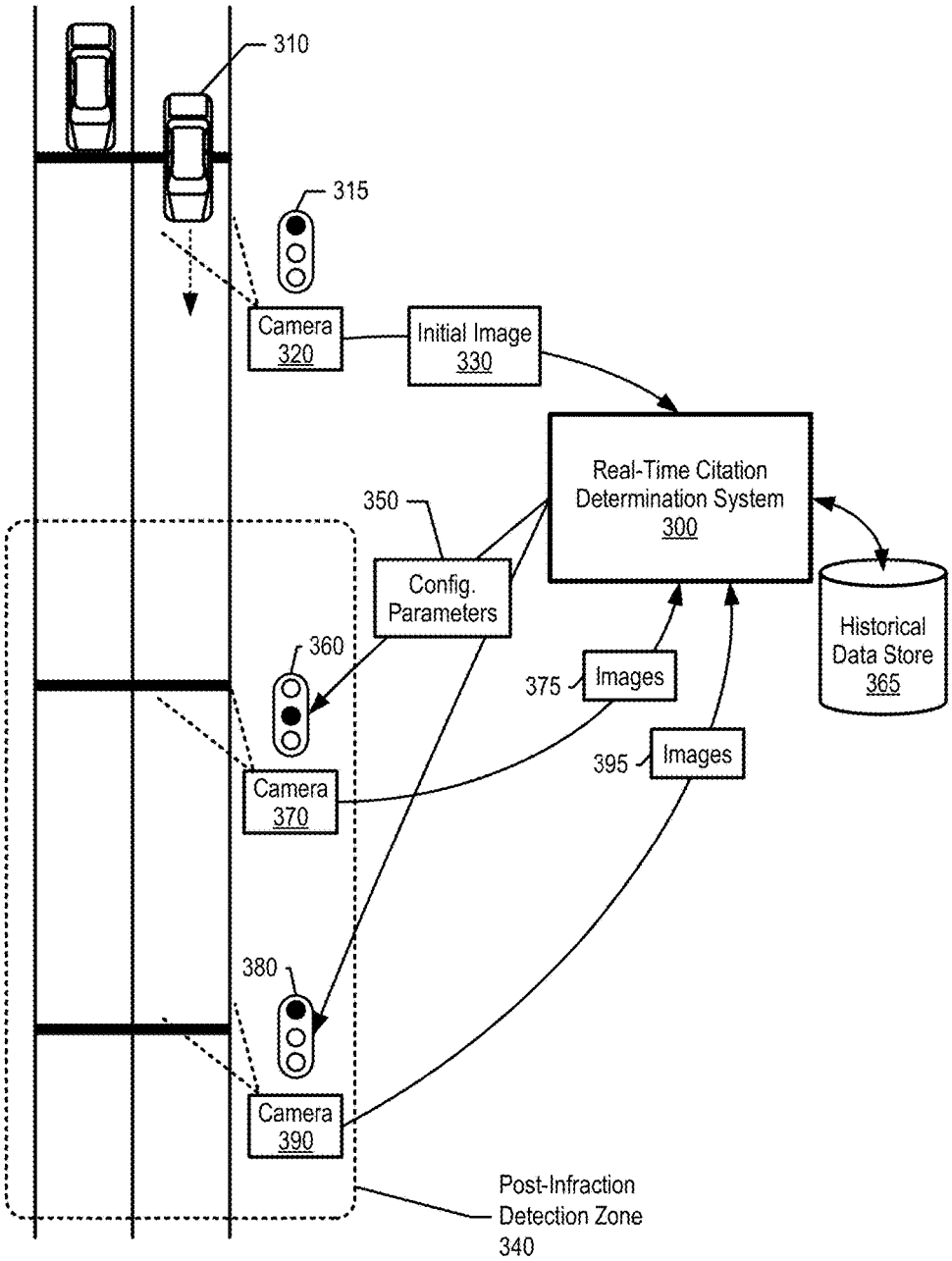
FIG. 3 is a high-level diagram depicting an example of a real-time citation determination system that detects an initial vehicle infraction and determines whether to issue a citation based on various prior and subsequent driving behaviors.

FIG. 3 is a high-level diagram depicting an example of a real-time citation determination system that detects an initial vehicle infraction and determines whether to issue a citation based on various prior and subsequent driving behaviors. As discussed earlier, current traffic infraction detection systems issue citations when an infraction is detected and do not take into account other ancillary factors that may have attributed to the infraction. Real-time citation determination system 300 provides a behavioral-based citation determination system that 1) captures, records, and analyzes traffic infractions from multiple inputs; 2) forms a post-infraction detection zone to monitor a driver's real-time behavior subsequent to a detected infraction; 3) performs behavioral analysis based on a driver's historical infraction records; and 4) identifies and reports an unusual amount of infractions from other drivers within an infraction area.

Real-time citation determination system 300 receives data from devices within an infraction detection network upon detecting a traffic infraction. FIG. 3 shows that camera 320 captured initial image 330 of vehicle 310 running red light 315. Real-time citation determination system 300 receives initial image 330 and identifies vehicle 310, such as by vehicle 310's license plate.

Real-time citation determination system 300 determines the direction of vehicle 310 and forms post-infraction detection zone 340 to monitor the driver's behavior subsequent to the initial traffic infraction. Post-infraction detection zone 340, as shown in FIG. 3, includes two upcoming intersections that include traffic control devices such as lights 360 and 380. As discussed herein, a traffic control device may be a device such as a stop sign, a yield sign, a stop light, a speed limit sign, a carpool sign, a bus lane sign, a traffic controller, or any device that relates to controlling vehicle traffic behavior.

Real-time citation determination system 300 sends configuration parameters 350, which includes vehicle identification information and a set of traffic control actions, to lights 360 and 380 to test the driving behavior of vehicle 310's driver. For example, lights 360 and 380 may be connected to a plate detection system and are configured to turn yellow when the plate detection system detects vehicle 310 approaching the intersections.

Traffic capturing devices, such as cameras 370 and 390, capture images 375 and 395 of vehicle 310 as it approaches their corresponding intersections, regardless of whether vehicle 310 runs lights 360 or 380 when they turn red. Real-time citation determination system 300 analyzes images 375 and 395 to determine whether the driver of vehicle 310 frequently runs red lights or whether the initial infraction was an uncommon action of the driver. Based on real-time citation determination system 300's analysis, real-time citation determination system 300 issues a citation or records the infraction in historical data store 365 without issuing a citation (see FIG. 5 and corresponding text for further details).

In addition, to further assess the driver's normal driving behavior, real-time citation determination system 300 retrieves historical information corresponding to the driver of vehicle 310 from historical data store 365 that includes, for example, past infractions and citations issued to the driver. Real-time citation determination system 300 then determines whether to issue a citation or record the infraction accordingly (see FIG. 6 and corresponding text for further details).

Furthermore, real-time citation determination system 300 analyzes the infraction area of the initial infraction to determine whether the infraction area itself is causing an unusual amount of infractions. For example, a blind intersection or a steep downhill road may cause an unusual amount of red light infractions or speeding infractions, respectively. As such, real-time citation determination system 300 takes infraction patterns of the infraction area into account when determining whether to issue a citation to the driver or log the infraction (see FIG. 7 and corresponding text for further details).

Figure 4:
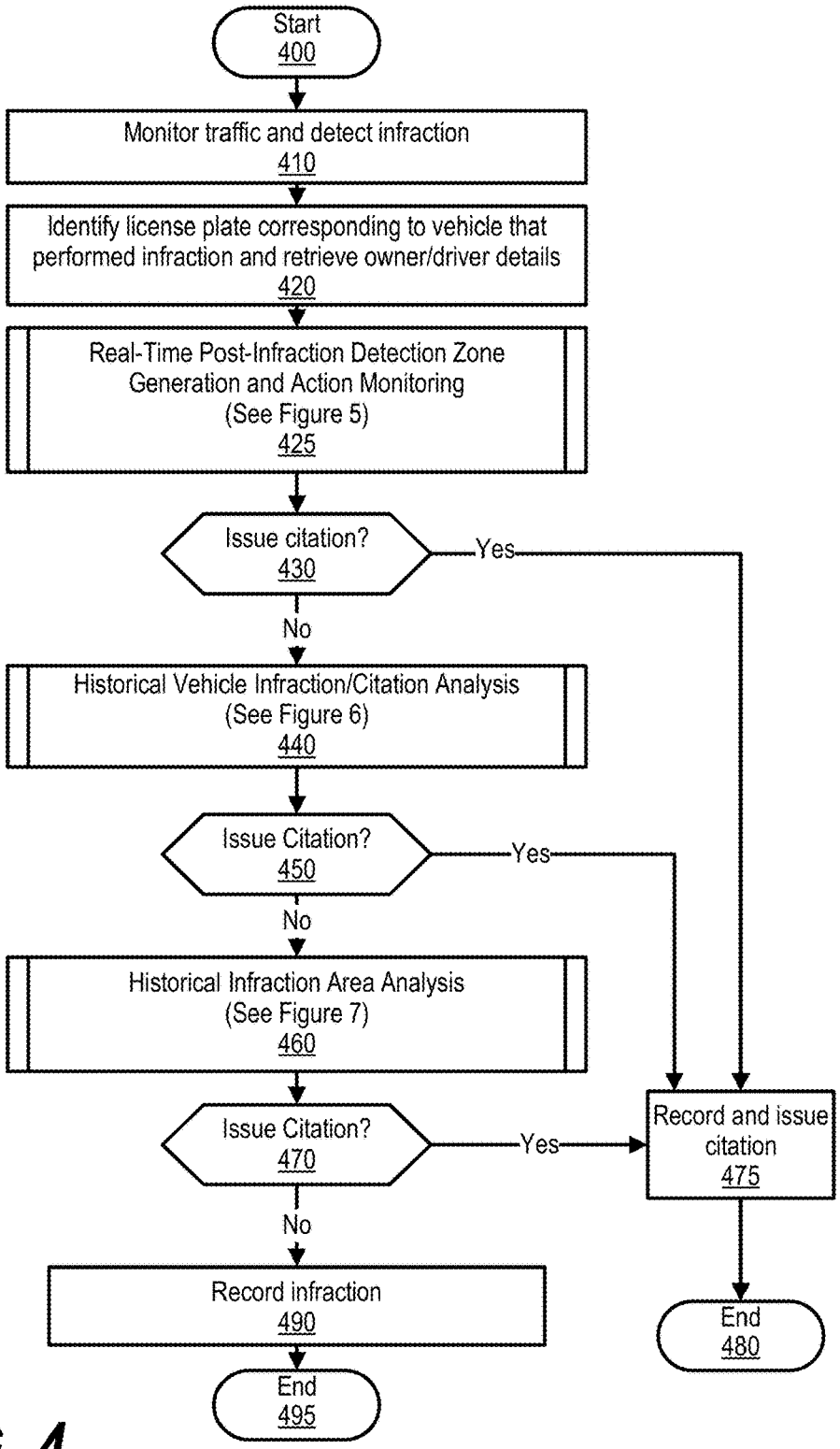
FIG. 4 is a flowchart depicting an example of steps taken to determine whether to issue a citation to a driver of a vehicle that performed a traffic infraction.

FIG. 4 is a flowchart depicting an example of steps taken to determine whether to issue a citation to a driver of a vehicle that performed a traffic infraction. Processing commences at 400 whereupon, at step 410, the process monitors traffic and detects an infraction. At step 420, the process identifies a license plate corresponding to the vehicle that performed the infraction and retrieves owner/driver details. For example, the vehicle may be registered under "John Doe" and, in one embodiment, the process retrieves owner/driver information for each vehicle registered under "John Doe."

At predefined process 425, the process forms a real-time post-infraction detection zone and monitors the vehicle's actions through the real-time post-infraction detection zone. Referring to FIG. 3, the process forms post-infraction detection zone 340 and sends configuration parameters 350 to traffic control devices within post-infraction detection zone 340 (see FIG. 5 and corresponding text for processing details).

The process determines as to whether to issue a citation based on the results of analyzing vehicle actions through the post-infraction detection zone (decision 430). For example, the driver may have initially ran a red light (detected infraction) but the driver did not run subsequent red lights or yellow lights through the post-infraction detection zone. If the driver should be issued a citation, then decision 430 branches to the 'yes' branch whereupon, at step 475, the process records and issues the citation. FIG. 4 processing thereafter ends at 480.

On the other hand, if the driver should not be issued a citation based on the vehicle actions collected through the infraction detection zone, then decision 430 branches to the 'no' branch. At predefined process 440, the process analyzes historical vehicle/driver infraction/citations to determine whether to issue a citation. For example, the driver may be a repeat offender of driving through red lights (see FIG. 6 and corresponding text for processing details).

The process determines as to whether issue a citation based on the results of analyzing the historical vehicle/driver infraction/citations (decision 450). In one embodiment, the process also takes into account the infraction detection zone actions obtained at step 425 in combination with the historical vehicle/driver infraction/citations to determine whether to issue a citation. If the driver should be issued a citation, then decision 450 branches to the 'yes' branch whereupon, at step 475, the process records and issues the citation. FIG. 4 processing thereafter ends at 480.

On the other hand, if the driver should not be issued a citation based on analyzing the historical vehicle/driver infraction/citations, then decision 450 branches to the 'no' branch. At predefined process 460, the process evaluates historical infractions and citations corresponding to the infraction area to determine whether an issue exists with the infraction area. For example, the infraction area may be a steep downhill road where the speed limit decreases from 70 mph to 50 mph for no apparent reason, thus generating a large amount of speeding infractions (see FIG. 7 and corresponding text for processing details). The process determines as to whether to issue a citation based on the historical infraction analysis (decision 470). In one embodiment, the process also takes into account the post-infraction detection zone actions obtained at step 425 in combination with the historical vehicle/driver infraction/citations analyzed at step 440, in combination with the historical infraction area analysis from step 460 to determine whether to issue a citation.

If the driver should be issued a citation, then decision 470 branches to the 'yes' branch whereupon, at step 475, the process records and issues the citation. FIG. 4 processing thereafter ends at 480. On the other hand, if the process should not issue a citations, then decision 470 branches to the 'no' branch. At step 490, the process records an infraction of the vehicle/driver and FIG. 4 processing thereafter ends at 495.

Figure 5:
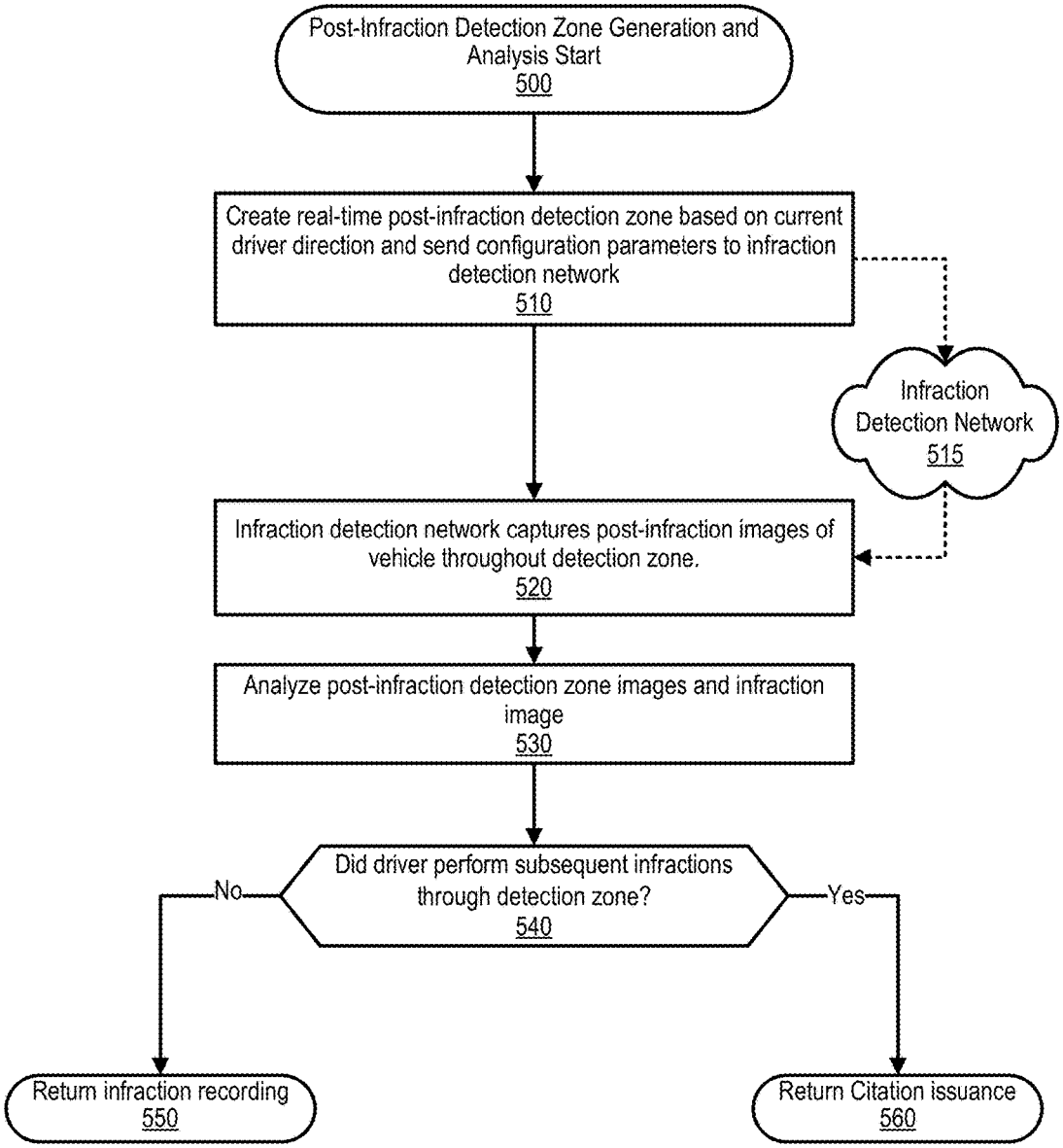
FIG. 5 is a flowchart depicting an example of steps taken to form a post-infraction detection zone subsequent to detecting an initial infraction and monitor vehicle actions through the infraction detection zone.

FIG. 5 is a flowchart depicting an example of steps taken to form a post-infraction detection zone subsequent to detecting an initial infraction and monitor vehicle actions through the infraction detection zone. FIG. 5 processing commences at 500 whereupon, at step 510, the process creates a post-infraction detection zone in real-time based on the driver's direction that is detected during the infraction and sends configuration parameters to infraction detection network 515 that includes identification data to identify the vehicle. Infraction detection network 515, in one embodiment, includes traffic control devices such as traffic lights, cameras, electronic speed limit signs, etc., that are along the route of the vehicle in infraction.

At step 520, the process captures post-infraction information from infraction detection network, such as images of the vehicle, throughout the post-infraction detection zone. At step 530, the process analyzes the post-infraction images along with the detected infraction image, and determines as to whether the driver performed subsequent infractions through the post-infraction detection zone (decision 540). If the driver did not perform subsequent infractions through post-infraction detection zone, then decision 640 branches to the 'no' branch whereupon the process returns an infraction recording to the calling routine to record the infraction but not issue a citation (see FIG. 4) at 550. On the other hand, if the driver did perform subsequent infractions through the post-infraction detection zone, then decision 540 branches to the 'yes' branch whereupon the process returns a citation issuance to the calling routine (see FIG. 4) at 560.

Figure 6:
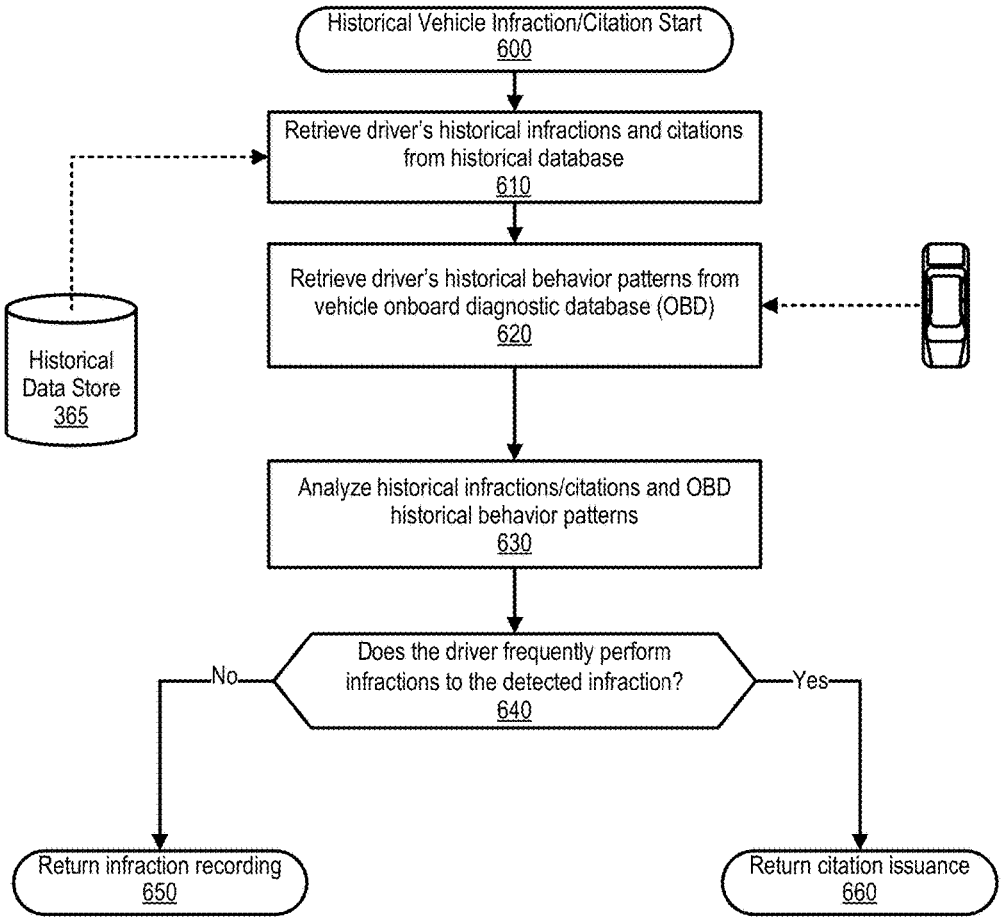
FIG. 6 is a flowchart depicting an example of steps taken to analyze historical behavior of a driver/vehicle to determine whether to issue a citation for a current infraction.

FIG. 6 is a flowchart depicting an example of steps taken to analyze historical behavior of a driver/vehicle to determine whether to issue a citation for a current infraction. FIG. 6 processing commences at 600 whereupon, at step 610, the process retrieves the driver's historical infractions and citations from historical data store 365. In one embodiment, the process retrieves historical infractions and citations corresponding to each vehicle that is registered to the driver.

At step 620, the process retrieves the driver's historical behavior patterns from vehicle onboard diagnostic database (OBD) located in vehicle 310. At step 630, the process analyzes the historical infractions/citations and the OBD historical behavior patterns, and determines as to whether the driver frequently performs an infraction similar to the detected infraction, such consistently speeding (decision 740). If the driver does not frequently perform an infraction similar to the detected infraction, then decision 640 branches to the 'no' branch whereupon the process returns an infraction recording to the calling routine to record the infraction (see FIG. 4) at 650. On the other hand, if the driver frequently performs an infraction similar to the detected infraction, then decision 640 branches to the 'yes' branch whereupon the process returns a citation issuance to the calling routine (see FIG. 4) at 660.

Figure 7:
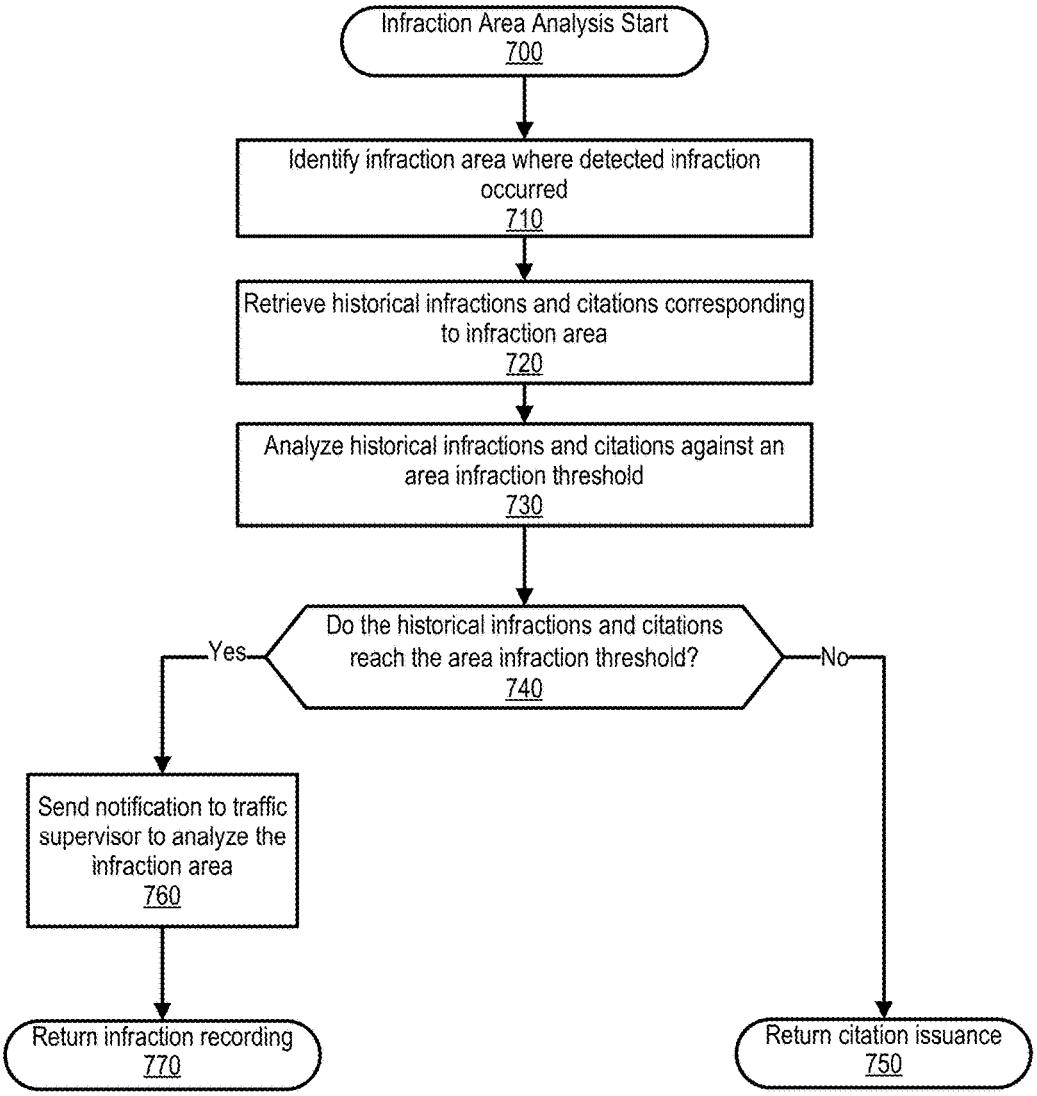
FIG. 7 is a flowchart depicting an example of steps taken to analyze an infraction area (location) of the infraction and determine whether the infraction area attributes to an unusually large amount of infractions.

FIG. 7 is a flowchart depicting an example of steps taken to analyze an infraction area (location) of the infraction and determine whether the infraction area attributes to an unusually large amount of infractions. FIG. 7 processing commences at 700 whereupon, at step 710, the process identifies an infraction area where the detected infraction occurred. For example, the infraction area may be an intersection with an obstructed stop sign.

At step 720, the process retrieves historical infractions and citations corresponding to the infraction area and, at step 730, the process analyzes the amount of historical infractions and citations against an infraction area threshold. In one embodiment, the process sets the infraction area threshold based on the amount of traffic that passes through the infraction area. In another embodiment, the process sets the infraction area threshold based on the amount of residents/businesses in proximity to the infraction area. In yet another embodiment, the process receives a pre-determined infraction area threshold from a user.

The process determines as to whether the historical infractions and citations reach the infraction area threshold (decision 740). If the historical infractions and citations do not reach the infraction area threshold, then decision 740 branches to the 'no' branch whereupon the process returns a citation issuance to the calling routine (see FIG. 4) at 750.

On the other hand, if the historical infractions and citations reach the infraction area threshold, thus indicating an issue with the infraction area, then decision 740 branches to the 'yes' branch whereupon, at step 760, the process sends a notification to traffic supervisor to analyze the infraction area and returns an infraction recording to the calling routine to record the infraction (see FIG. 4) at 770.

While particular embodiments of the present disclosure have been shown and described, it will be obvious to those skilled in the art that, based upon the teachings herein, that changes and modifications may be made without departing from this disclosure and its broader aspects. Therefore, the appended claims are to encompass within their scope all such changes and modifications as are within the true spirit and scope of this disclosure. Furthermore, it is to be understood that the disclosure is solely defined by the appended claims. It will be understood by those with skill in the art that if a specific number of an introduced claim element is intended, such intent will be explicitly recited in the claim, and in the absence of such recitation no such limitation is present. For non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to disclosures containing only one such element, even when the same claim includes the introductory phrases "one or more" or "at least one" and indefinite articles such as "a" or "an"; the same holds true for the use in the claims of definite articles.

The invention claimed is:

1. A method implemented by an information handling system that includes a memory and a processor, the method comprising:

forming an infraction detection zone in response to detecting a traffic infraction of a driver driving a vehicle, wherein the infraction detection zone comprises a set of traffic control devices and wherein a location of the traffic infraction is at an infraction area;

sending a set of configuration parameters to the set of traffic control devices that comprise vehicle identification data;

identifying, based on the vehicle identification data, one or more driving behaviors of the driver through the infraction detection zone;

determining an amount of historical traffic infractions from a plurality of different drivers at the infraction area;

in response to determining that the amount of historical traffic infractions does not exceed a threshold, issuing a citation based on analyzing the one or more driving behaviors; and in response to determining that the amount of historical traffic infractions exceeds the threshold, suppressing the citation and recording the traffic infraction of the driver.

2. The method of claim 1 further comprising:

identifying a direction of travel of the vehicle subsequent to detecting the traffic infraction; and assigning, based on the identified direction of travel, the set of traffic control devices and a corresponding set of traffic capturing devices to the infraction detection zone.

3. The method of claim 2 wherein, subsequent to the traffic infraction, at least a selected one of the set of traffic control devices performs an action in response to detecting the vehicle in proximity, the method further comprising:

receiving a set of images from one of the traffic capturing devices in response to the selected traffic control device performing the action; and utilizing the set of images during the analyzing of the one or more driving behaviors.

4. The method of claim 1 wherein, in response to determining that the amount of the plurality of historical traffic infractions exceeds the threshold, the method further comprises: sending a notification to an administrator that indicates the amount of historical traffic infractions.

5. The method of claim 1 wherein at least one of the set of traffic control devices is selected from the group consisting of a stop sign, a yield sign, a stop light, a speed limit sign, a carpool sign, a bus lane sign, and a traffic controller.

6. The method of claim 1 further comprising:

suppressing the citation in response to determining that the driver has not committed one or more historical traffic infractions prior to the detected traffic infraction; and performing the issuance of the citation based on determining that the driver has committed one or more historical traffic infractions prior to the detected traffic infraction.

7. An information handling system comprising:

one or more processors;

a memory coupled to at least one of the processors;

a set of computer program instructions stored in the memory and executed by at least one of the processors in order to perform actions of:

forming an infraction detection zone in response to detecting a traffic infraction of a driver driving a vehicle, wherein the infraction detection zone comprises a set of traffic control devices and wherein a location of the traffic infraction is at an infraction area;

sending a set of configuration parameters to the set of traffic control devices that comprise vehicle identification data;

identifying, based on the vehicle identification data, one or more driving behaviors of the driver through the infraction detection zone;

determining an amount of historical traffic infractions from a plurality of different drivers at the infraction area;

in response to determining that the amount of historical traffic infractions does not exceed a threshold, issuing a citation based on analyzing the one or more driving behaviors; and in response to determining that the amount of historical traffic infractions exceeds the threshold, suppressing the citation and recording the traffic infraction of the driver.

8. The information handling system of claim 7 wherein the one or more processors perform additional actions comprising:

identifying a direction of travel of the vehicle subsequent to detecting the traffic infraction; and assigning, based on the identified direction of travel, the set of traffic control devices and a corresponding set of traffic capturing devices to the infraction detection zone.

9. The information handling system of claim 8 wherein, subsequent to the traffic infraction, at least a selected one of the set of traffic control devices performs an action in response to detecting the vehicle in proximity, and wherein the one or more processors perform additional actions comprising:

receiving a set of images from one of the traffic capturing devices in response to the selected traffic control device performing the action; and utilizing the set of images during the analyzing of the one or more driving behaviors.

10. The information handling system of claim 7 wherein, in response to determining that the amount of historical traffic infractions exceeds the threshold, the one or more processors perform additional actions comprising:

sending a notification to an administrator that indicates the amount of the plurality of historical traffic infractions.

11. The information handling system of claim 7 wherein at least one of the set of traffic control devices is selected from the group consisting of a stop sign, a yield sign, a stop light, a speed limit sign, a carpool sign, a bus lane sign, and a traffic controller.

12. The information handling system of claim 7 wherein the one or more processors perform additional actions comprising:

suppressing the citation in response to determining that the driver has not committed one or more historical traffic infractions prior to the detected traffic infraction; and performing the issuance of the citation based on determining that the driver has committed one or more historical traffic infractions prior to the detected traffic infraction.

13. A computer program product stored in a non-transitory computer readable storage medium, comprising computer program code that, when executed by an information handling system, causes the information handling system to perform actions comprising:

forming an infraction detection zone in response to detecting a traffic infraction of a driver driving a vehicle, wherein the infraction detection zone comprises a set of traffic control devices and wherein a location of the traffic infraction is at an infraction area;

sending a set of configuration parameters to the set of traffic control devices that comprise vehicle identification data;

identifying, based on the vehicle identification data, one or more driving behaviors of the driver through the infraction detection zone;

determining an amount of historical traffic infractions from a plurality of different drivers at the infraction area;

in response to determining that the amount of historical traffic infractions does not exceed a threshold, issuing a citation based on analyzing the one or more driving behaviors; and in response to determining that the amount of historical traffic infractions exceeds the threshold, suppressing the citation and recording the traffic infraction of the driver.

14. The computer program product of claim 13 wherein the information handling system performs further actions comprising:

identifying a direction of travel of the vehicle subsequent to detecting the traffic infraction; and assigning, based on the identified direction of travel, the set of traffic control devices and a corresponding set of traffic capturing devices to the infraction detection zone.

15. The computer program product of claim 14 wherein, subsequent to the traffic infraction, at least a selected one of the set of traffic control devices performs an action in response to detecting the vehicle in proximity, and wherein the information handling system performs further actions comprising:

receiving a set of images from one of the traffic capturing devices in response to the selected traffic control device performing the action; and utilizing the set of images during the analyzing of the one or more driving behaviors.

16. The computer program product of claim 13 wherein, in response to determining that the amount of historical traffic infractions exceeds the threshold, the information handling system performs further actions comprising:

sending a notification to an administrator that indicates the amount of the plurality of historical traffic infractions.

17. The computer program product of claim 13 wherein the information handling system performs further actions comprising:

suppressing the citation in response to determining that the driver has not committed one or more historical traffic infractions prior to the detected traffic infraction; and performing the issuance of the citation based on determining that the driver has committed one or more historical traffic infractions prior to the detected traffic infraction.

* * * * *